United States Patent [19]

Mazie et al.

[11] 4,064,988

[45] Dec. 27, 1977

[54] DISPLAY CONTAINER

[76] Inventors: Lowell I. Mazie, 2126 Packard Road; Henry C. Friedman, 1906 Foothill Drive, both of, Huntingdon Valley, Pa. 19006; Nathaniel Getzler, 1213 Davisville Road, Southampton, Pa. 18966; Jack D. Grollman, 550 Lafayette Road, Merion, Pa. 19066

[21] Appl. No.: 709,552

[22] Filed: July 29, 1976

[51] Int. Cl.[2] ..... B65D 5/32

[52] U.S. Cl. ..... 206/44 R; 229/17 R; 229/43

[58] Field of Search ..... 206/44 R, 815; 229/7 R, 229/7 SC, 16 R, 16 D, 17 R, 17 SC, 23 BT, 43

[56] References Cited

U.S. PATENT DOCUMENTS

| | | | |
|---|---|---|---|
| 3,245,527 | 4/1966 | Martin | 229/43 X |
| 3,593,908 | 7/1971 | Desmond et al. | 229/7 R X |
| 3,767,109 | 10/1973 | Paige | 229/23 BT X |
| 3,823,865 | 7/1974 | Mechnick | 229/17 R X |
| 3,865,300 | 2/1975 | Caveley et al. | 229/7 R |

*Primary Examiner*—Steven E. Lipman

*Attorney, Agent, or Firm*—Joseph G. Denny, III; Peter J. Patane

[57] ABSTRACT

A container comprising a box including integral opposed bottom and top walls, opposed side walls, and flaps forming opposed end walls. The box has a tapered opening formed by the top wall, the side walls and one of the end walls. A cover is received in the opening and the cover includes a lid wall, two legs integral with the lid wall, and an end wall integral with the lid wall. The legs rest on the bottom wall inside the box. The lid wall has a portion extending under the top wall of the box and the legs are high enough and long enough to bias a portion of the lid wall which extends under the top wall of said box against the latter.

12 Claims, 12 Drawing Figures

DISPLAY CONTAINER

BACKGROUND OF THE INVENTION

This invention relates to display containers for small items, such as household hardware items.

There appears to be a need for an easily manufactured container to be made from sheet material such as cardboard or paperboard or other suitably foldable sheet material which will provide a sufficiently strong shipping container and yet is light enough and attractive enough to be used to display the goods in a retail store.

Such display containers are used in retail stores where the contents are displayed in the container in which they are received. For this purpose, it is desirable that the container be provided with a readily removable cover to expose the contents of the container.

Containers are known in the prior art which are used to ship the goods and to display them. However, such prior art containers require that a portion of the container be torn or cut off to provide an opening through which the contents of the container are accessible. In this invention, the containers need not be torn or cut open, since a readily removable cover or insert is provided which closes off the opening when in place and which permits access to the interior of the container when it is lifted out.

BRIEF SUMMARY OF THE INVENTION

Thus, it is an object of this invention to provide a relatively inexpensive display container with a cover that may be easily removed by the retailer to display the goods.

The display container comprises a box including integral opposed bottom and top walls, opposed side walls, and flaps forming opposed end walls. The box has a tapered opening formed by the top wall, the side walls and one of the end walls. A cover is received in the opening and the cover includes a lid wall, two legs integral with the lid wall, and an end wall integral with the lid wall. The legs rest on the bottom wall inside the box. The lid wall has a portion extending under the top wall of the box and the legs are high enough and long enough to bias a portion of the lid wall which extends under the top wall of said box against the latter.

The foregoing and other objects of the invention, the principles of the invention and the best mode in which I have contemplated applying such principles will more fully appear from the following description and accompanying drawings in illustration thereof.

BRIEF DESCRIPTION OF THE VIEWS

Figure 6:
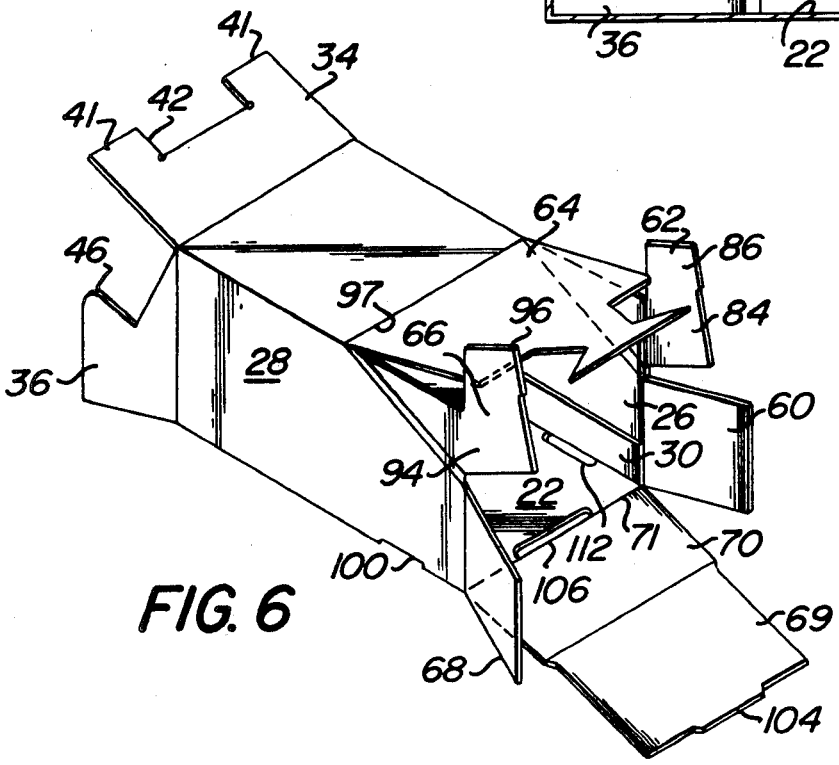
Figure 7:
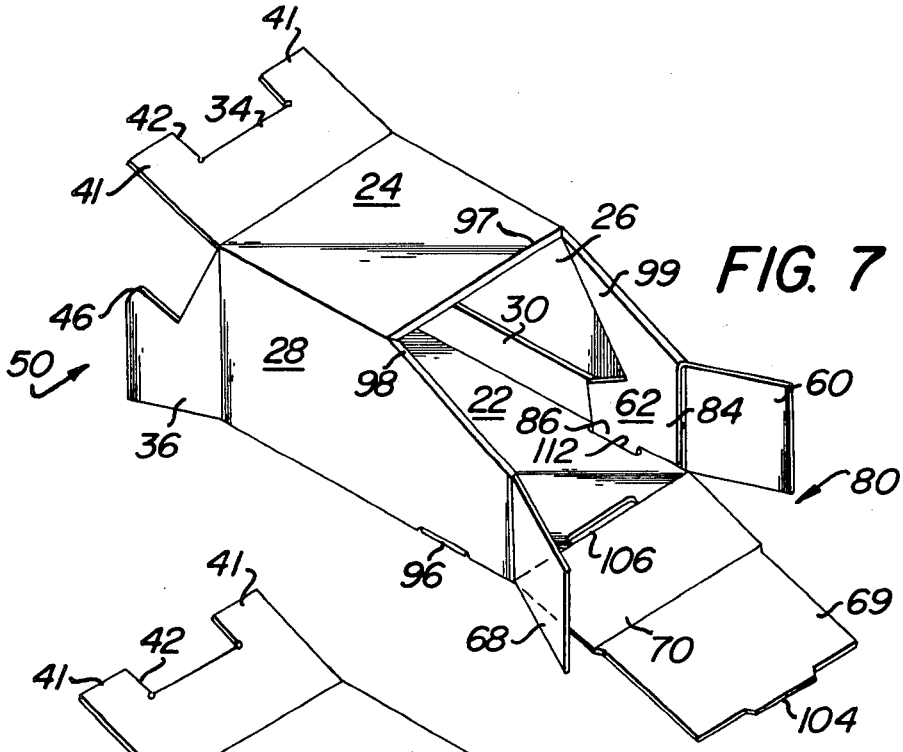
Figure 8:
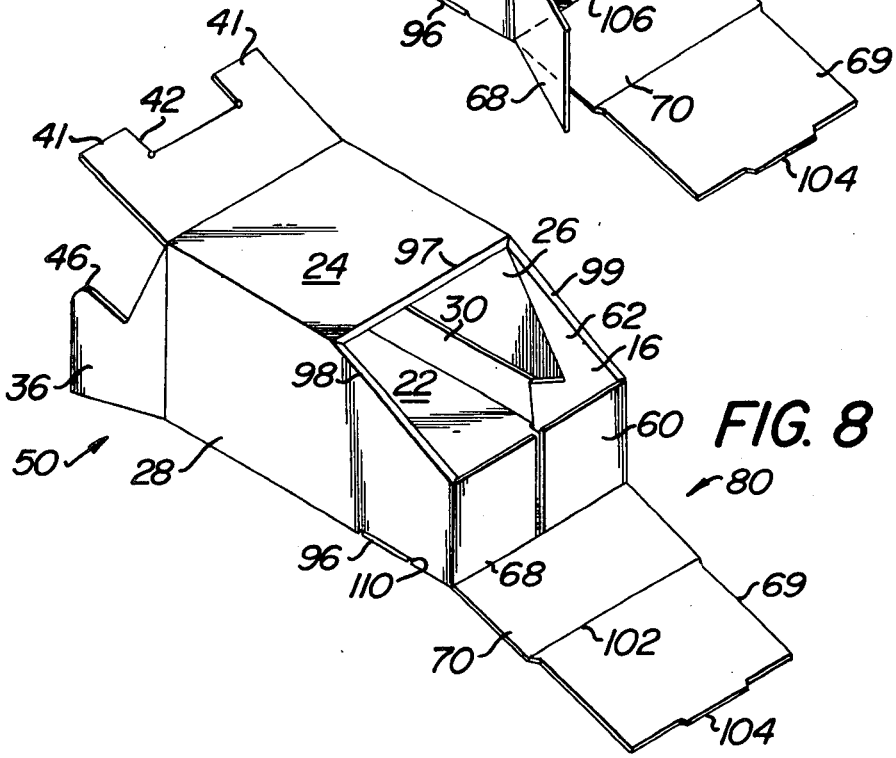

FIGS. 6 through 8, inclusive, are top and front perspective views of the box during various stages of assembly thereof; and FIGS. 9 through 12, inclusive are top and back perspective views of the display container during various stages of assembly thereof.

DESCRIPTION OF THE PREFERRED EMBODIMENT

Referring to the drawings, the display container 10 comprises a box 12 and a cover or insert 14 which fits snugly into a tapered opening 16 at the front and top of the box 12. The cover or insert 14 may be easily lifted out of the box 12 when it is desired to provide an access to the contents of the box. The cover or insert 14 "squares off" the box 12, as shown, to facilitate stacking and shipping of the containers.

Figure 1:
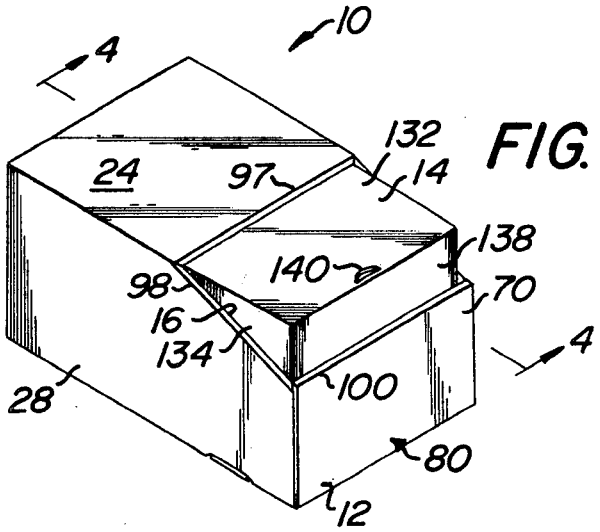
FIG. 1 is a front and top perspective view of the display container incorporating the present invention.
Figure 2:
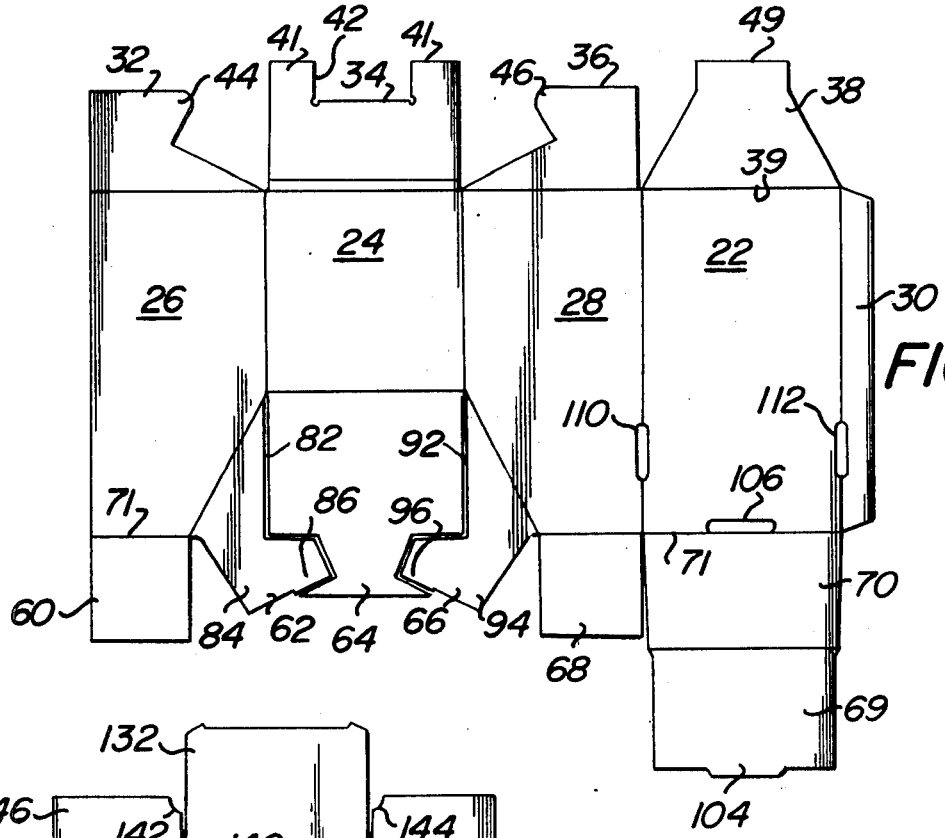
FIG. 2 is a plan view of a flat blank from which the box shown in FIG. 1 is formed, FIG. 2 being enlarged relative to FIG. 1.

The box 12 is formed from a blank 18, FIG. 2, of suitable sheet material such as cardboard or paperboard. Likewise, the cover or insert 14 is formed from a blank 20, FIG. 3, of suitable sheet material.

The blank 18 is scored to provide a bottom wall 22 and an opposed top wall 24 and two opposed side walls 26 and 28. The blank 18 includes a marginal lip 30 which overlaps the side wall 26, FIGS. 7 and 8, and is preferably secured thereto by a suitable adhesive, when the box is assembled.

The upper portion of the blank 18, as viewed in FIG. 2, is provided with integral flaps 32, 34, 36 and 38 extending from the side 26, top 24, side 28 and bottom 22, respectively. The flap 34 is provided with spaced two legs 41 defining an inverted U-shaped, central opening 42 which (when the box is assembled) becomes the innermost flap, as shown in FIGS. 9 through 12, inclusive. The flaps 32 and 36 are then folded against the flap 34 and lobes 44 and 46 formed on the flaps 32 and 36, respectively, are tucked behind the flap 34 through the opening 42 and between the legs 41 of the opening 42, but the flaps 32 and 36 abut and overlap the portions of the central flap 34 on opposite sides of the opening 42.

Figure 11:
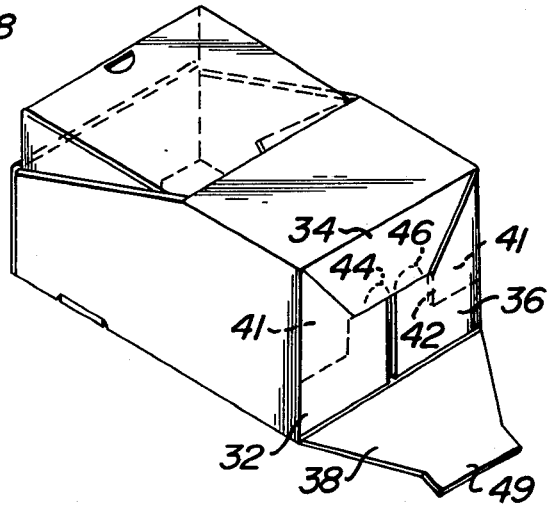
Figure 12:
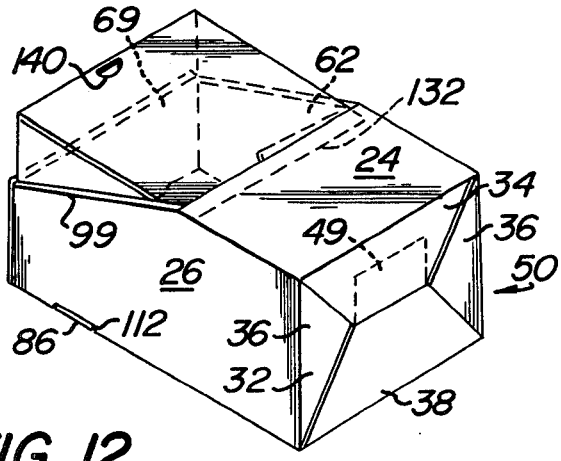

The lobes 44 and 46 are formed adjacent the upper margins of the flaps 32 and 36 so that when the flaps 32 and 36 are brought together, as shown in FIGS. 11 and 12, the lobes 44 and 46 will be disposed next to each other and centrally along the flap 34 so that the lobes 44 and 46 enter the opening 42 and become lodged behind the flap 34. To form the lobes 44 and 46, the flaps 32 and 36 are cut symmetrically, at a taper, as approximately shown in FIG. 2, forming generally opposed V-shapes.

To further strengthen the box, the flap 38 is provided with a central tongue 49 which is inserted into the opening 42 and on top of the lobes 44 and 46, pushing the latter back, the tongue 49 becoming inserted behind the flap 38, compare FIGS. 11 and 12.

The flaps 32, 34, 36 and 38 are all scored along a common horizontal line 39, as shown in FIG. 2, so that when the flaps are folded toward each other, a closing end wall 50 is formed, see FIG. 12, which is generally perpendicular to the horizontal bottom 22, top 24 and sides 26 and 28.

The lower portion of the blank 18, as viewed in FIG. 2, is provided with multiple integral flaps 60 and 62 extending from the side wall 26, a central flap 64 extending from the top 24, integral flaps 66 and 68 extending from the side wall 28, and a locking flap 70 extending from the bottom 22. The flaps 60, 68 and 70 are all scored along a common horizontal line 71, as shown in FIG. 2, so as to form an end wall 80 (when folded), see FIG. 12, which is opposed to the end wall 50 and perpendicular to the top, bottom and sides of the box.

The flap 62 is cut along the line 82 from the central flap 64 to form a heel 84 and a foot 86, the flap 62 being scored at its juncture with the side 26 along an angle so that when the blank is folded, the side 26 will have a top and front portion sloping at an angle, as shown in FIGS. 2, 7 and 8.

Likewise, the flap 66 is cut along the line 92 from the flap 64 to form a heel 94 and a foot 96, the flap 66 being scored at its juncture with the side 26 along an angle so that when the blank is folded, the side 28 will have a top and front portion sloping at an angle, as shown in FIGS. 2, 7 and 8.

The cut lines 82 and 92 are made symmetrical about the central flap 64 so that the sides 26 and 28 will be uniformly tapered and define edges 98 and 99, FIGS. 7 and 8.

Figure 4:
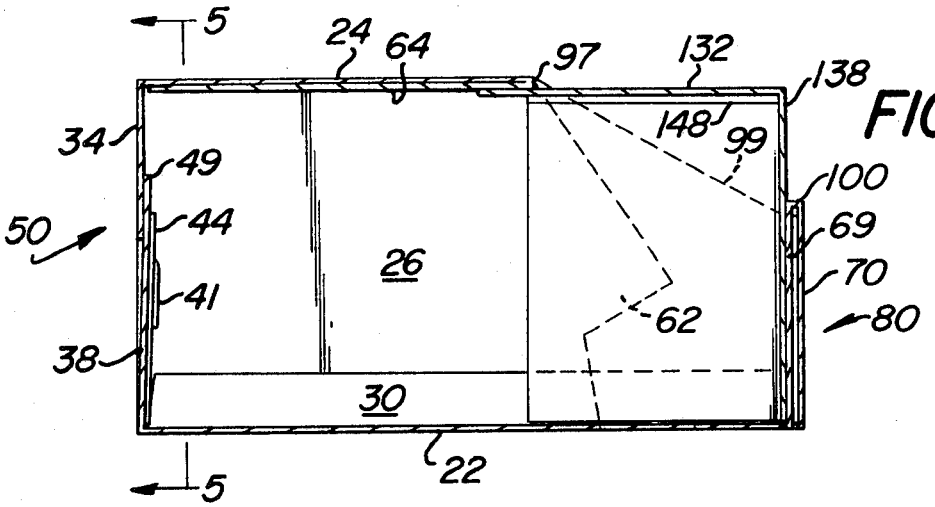
FIG. 4 is a longitudinal sectional view taken along the line 4—4 in FIG. 1, but at a larger scale than FIG. 1.
Figure 5:
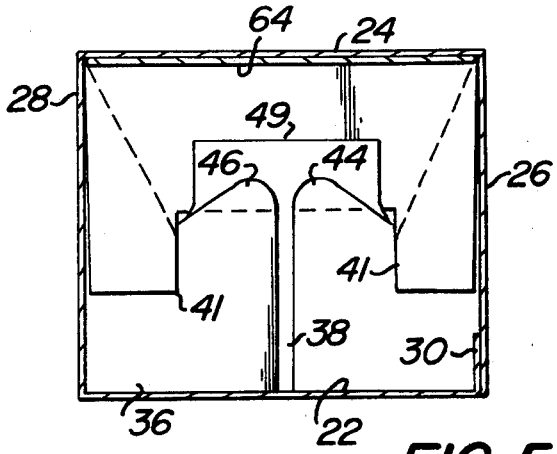
FIG. 5 is a cross-sectional view taken along the line 5—5 in FIG. 4.

The central flap 64 is preferably folded back and under the top 24, to the positions shown in FIGS. 4 and 5, to strengthen the top of the box (because the flap 64 extends snugly between the inside surfaces of the sides 26 and 28 and also strengthens the leading edge 97).

The leading edge 97, the tapered edges 98 and 99 (of the sides), and the folded edge 100 (FIG. 9) of the flap 70 together define the tapered opening 16 at the front and top of the box 12.

To assemble the box 12, the central flap 64 is folded back under the top 24 and the flaps 64 and 66 are folded back against the sides 26 and 28, respectively, FIGS. 6 and 7. The bottom wall 22 is provided with slots 110 and 112 to receive the feet 86 and 96. The flaps 60 and 68 are then folded toward each other, FIGS. 7 and 8, and the flap 70 is raised toward the flaps 60 and 68 and folded inwardly along the score line 102 (FIG. 8) to form the previously mentioned edge 100 (FIG. 9).

The flap 70 has a central projection 104 which, when the flap 70 is folded into the box, becomes inserted into a central slot 106 formed immediately above the horizontal score line 71, as viewed in FIG. 2, to provide additional rigidity to the end wall 80. To retain the flaps 62 and 66 against the side walls the flap 70 includes a section 69 of reduced width but wide enough to fit inside and to abut the flaps 62 and 66.

Figure 9:
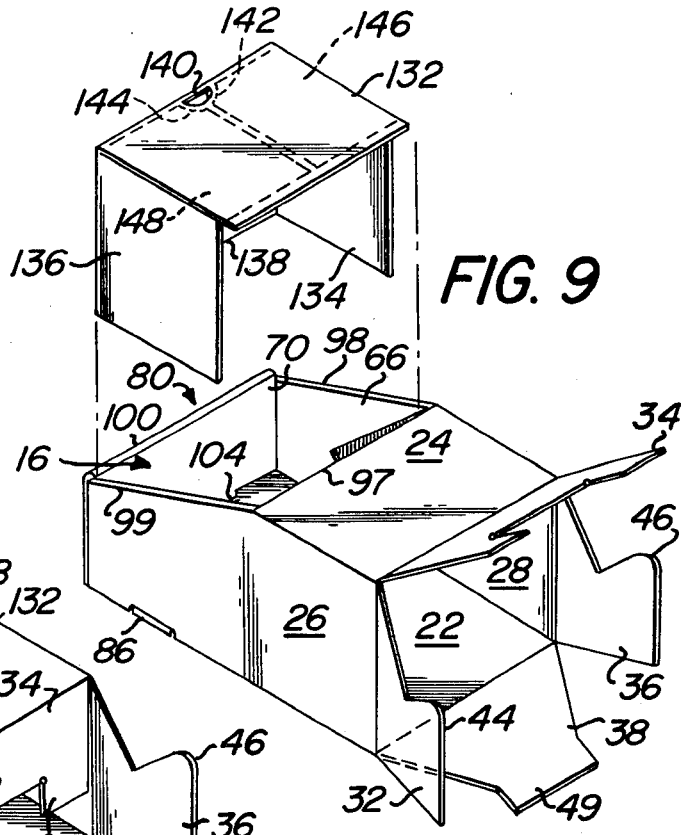

The flaps 62 and 66 are folded back against the sides 26 and 28 to strengthen the latter at the tapered opening 16 and to strengthen the tapering edges 98 and 99, FIG. 8, th flaps 62 and 66 being locked against the side walls by the feet 86 and 96 and the folded over part of the flap 70 which extends between the flaps 62 and 66, as seen in FIGS. 7, 8 and 9.

For further rigidity, the heels 84 and 94 rest on the bottom wall 22. Also, the flap 64 extends to the rear, as shown in FIG. 4, to abut the end flap 34.

Figure 3:
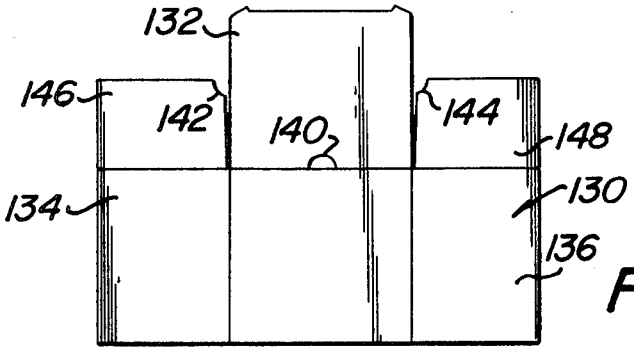
FIG. 3 is a plan view of a flat blank from which the cover shown in FIG. 1 is formed, FIG. 3 being enlarged relative to FIG. 1.

The opening 16 is closed by the cover 14 which is made from a suitable blank 130 of sheet material but scored as shown in FIG. 3.

The cover 14 comprises a lid wall 132 folded at approximately right angles to opposed legs 134 and 136 and to an end wall 138, FIG. 9. The lid wall 132 has a semi-circular opening 140 which overlies arcuate spaces defined by edges 142 and 144 formed on support walls 146 and 148, respectively, extending integrally from the legs 134 and 136. When the blank 130 is folded to the position shown in FIG. 9, for example, the opening 140 overlies the arcuate spaces 142 and 144 so that one's finger may be placed through them to remove the cover 14 from the box 12.

The legs 134 and 136 and the end wall 138 are rigid enough to support the lid wall 132, as shown. Further, the legs 134 and 136 and the end wall 138 are long enough to rest on the bottom wall 22 of the box when the cover 14 is inserted into the opening 16. Also, the lid wall 132 is long enough to extend under the top wall 24, as shown in FIGS. 4, 10 and 12.

To assure a close fit, the legs 134 and 136 and the end wall 138 are made long enough to bias the portion of the lid wall 132 under the top wall 24 against the flap 64 which (when the box is assembled lies under the top wall 24.

After the box 12 and cover 14 are folded and assembled as shown and described, the contents may be inserted. If the box 12 is to be only partially filled, it has been found convenient to first completely assemble the box 12, then insert the contents through the tapered opening 16, and thereafter to close the opening 16 by inserting the cover 14. It will be understood that the portion of the lid wall 132 which lies under the top wall 24, as shown in FIG. 4, must be simultaneously deformed toward the end wall 80, pressed down, and then permitted to spring forward toward the opposite end wall 50.

Figure 10:
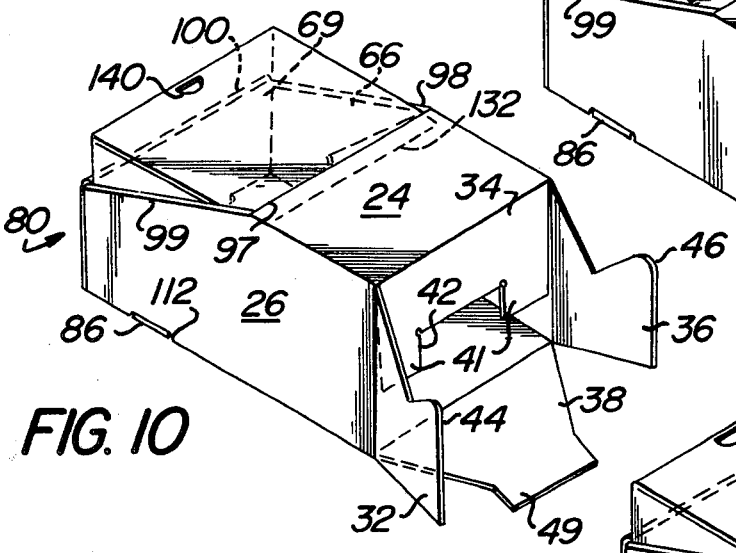

If the box 12 is to be completely filled, it has been found more convenient to partially assemble the box 12 to the extent shown in FIGS. 9 and 10. The cover 14 is added to it. Since the box 12 is empty, the cover 14 may be slid into the box from the back, i.e., the end which will form end wall 50. Thereafter the contents are placed into the box 12 through the back, (the end which will form the end wall 50). Thereafter, the flaps 32, 34, 36 and 38 are folded over and locked into each other in the position shown in FIG. 12.

From the foregoing it is seen that the display container 10 is provided in which the cover 14 telescopes with the box 12 to close the opening 16 in the latter. The end wall 138 and the legs 134 and 136 of the cover 14 are snugly and slidably received inside the box 12 against the side walls 26 and 28 and the front end wall 80 of the box. The lid 132 of the cover 14 is biased against the inside (lower) surface of the flap 64 which may be considered as part of the top wall of the box 12 when the box is assembled.

The legs 134 and 136 close off the tapered opening 16 at the sides, while the end wall 138 closes off the opening 16 at the front, the lid 132 closing the top of the opening 16. The legs 134 and 136, the end wall 138, and the lid 132 may be considered as providing "continuations" of the walls against which they respectively abut to provide a generally rectangular box with generally "continuous" outer surfaces.

When the contents are placed within the display container, the pressure of the contents will tend to bias the walls of the cover against the inside surfaces of the box, although the cover is sufficiently biased against the top wall of the box to remain in place without the pressure of the contents upon it.

We claim:

1. A container comprising a box including integral opposed bottom and top walls, opposed side walls, and flaps forming opposed end walls, said box having an opening formed by said top wall, said side walls and one of the end walls, a cover being received in said opening, said cover including a lid wall, two legs integral with said lid wall, and an end wall integral with said lid wall, said legs resting on said bottom wall inside said box, said lid wall having a portion extending under said top wall of said box, said legs being high enough and long enough to bias a portion of said lid wall which extends under the top wall of said box against the latter.

2. The combination of claim 1 wherein said opening in said box is tapered.

3. The combination of claim 2 wherein said side walls of said box are tapered to define the taper of said opening.

4. The combination of claim 3 wherein said lid wall includes a hole for facilitating removal of said cover from said box.

5. The combination of claim 4 wherein said box includes further flaps folded inwardly to reinforce said top wall, said side walls and the end wall which defines said opening.

6. The combination of claim 5 wherein said bottom wall has openings to receive portions of said further flaps to lock the latter to said bottom wall.

7. A display container comprising a box having top, bottom and side peripheral walls and opposed front and back end walls, said back end wall together with the four peripheral walls forming a closed end of said box, the front end wall together with three of the four peripheral walls defining an opening for said box which extends through the top wall, the two side walls, and the front end wall, a removable, separate cover received within said box to close said opening, said cover having portions resting on the bottom wall of said box and biased against the top wall of said box and overlapping with said side walls and said front end wall.

8. The combination of claim 7 wherein said box further includes flaps folded inwardly to reinforce said top wall, said side walls, and said front end wall at said opening.

9. The combination of claim 8 wherein said opening is tapered from the top wall down to the front end wall.

10. The combination of claim 9 wherein said bottom wall includes openings to receive portions of said flaps to lock the latter to the bottom wall.

11. The combination of claim 7 wherein said cover is snugly received between the side walls and the top and bottom walls so as to be able to be pushed from the back of the box to the front of the box when the latter is empty.

12. The combination of claim 7 wherein said cover is snugly received between the side walls and the top and bottom walls and is made of material which is sufficiently deformable and resilient enough so as to be deformed by hand pressure into said opening through the top thereof and then spring into closing relationship with said top wall of said box.

* * * * *